US005088116A

United States Patent [19]

Gould

[11] Patent Number: 5,088,116

[45] Date of Patent: Feb. 18, 1992

[54] ALL WEATHER GARMENT SYSTEM

[76] Inventor: Russell P. Gould, P.O. Box 262, Youngstown, Pa. 15696

[21] Appl. No.: 335,586

[22] Filed: Apr. 10, 1989

[51] Int. Cl.[5] ..... A11D 3/06

[52] U.S. Cl. ..... 2/82; 2/87; 2/88; 2/77; 2/79; 2/115; 2/119; 2/121; 2/126; 2/135; 2/227

[58] Field of Search ..... 2/94, 70, 71, 72, 73, 2/77, 79, 115, 119, 121, 122, 125, 126, 135, 160, 170, 227, 228, 229, 232, DIG. 2, DIG. 5, DIG. 6, 82, 87, 88

[56] References Cited

U.S. PATENT DOCUMENTS

| | | | |
|---|---|---|---|
| 1,515,149 | 11/1924 | Cohen | 2/87 |
| 1,975,285 | 10/1934 | Pearse | 2/115 |
| 2,320,783 | 6/1943 | Lee | 2/94 |
| 2,372,110 | 3/1945 | Noone | 2/87 |
| 2,411,922 | 12/1946 | Keohane | 2/82 |
| 2,465,286 | 3/1949 | Silver | 2/82 |
| 2,661,474 | 12/1953 | Tate | 2/94 |
| 3,085,250 | 4/1963 | Finlay | 2/94 |
| 3,737,916 | 6/1973 | Grenier | 2/70 |
| 4,390,996 | 7/1983 | Read | 2/70 |
| 4,554,682 | 11/1985 | Hillquist | 2/70 |
| 4,766,613 | 8/1988 | Wells | 2/227 |

FOREIGN PATENT DOCUMENTS

| | | | |
|---|---|---|---|
| 2444000 | 4/1976 | Fed. Rep. of Germany | 2/87 |
| 1333224 | 6/1962 | France | 2/70 |
| 1540344 | 3/1967 | France | 2/70 |

*Primary Examiner*—Werner H. Schroeder
*Assistant Examiner*—Gloria Hale
*Attorney, Agent, or Firm*—Ware Fressola et al.

[57] ABSTRACT

A self-contained clothing system comprising a foundation garment, typefied by a shirt-jacket and a pant, and several removable components, typefied by a hood, a sleeved yoke, and two chaps, which, all together and in conjunction with normal undergarments, serve to protect the wearer from the elements in changing weather conditions. This versatility of function is achieved through a design which incorporates removable components, pockets to carry said removable components, adjustable ventilation openings, and the use of appropriate fabrics.

11 Claims, 1 Drawing Sheet

ALL WEATHER GARMENT SYSTEM

BACKGROUND OF THE INVENTION

Persons who spend extended periods of time out of doors, for example hunters, fishermen, backpackers, military personnel, and persons engaged in certain occupations, require means to accommodate changes in climatic or other conditions, including precipitation, wind, temperature changes, and biting insects. Many garments are available to mitigate against these conditions, and must be carried or otherwise kept near at hand for use as and when required. The design and nature of these standby garments impose additional bulk, weight, and cost on such persons. The most common standby garments are articles of rainwear, which often suffer from the additional drawback of poor ventilation, causing the wearer's other garments to become wet with perspiration, especially when the wearer is exerting physical effort. Special purpose fabrics which permit the passage of perspiration while blocking the ingress of water have been developed to overcome this problem, but they are typically costly and difficult to seal along seams. Other designs incorporate protected ventilation openings, commonly under the arms or across the back, but these are fixed in nature, sometimes providing too little ventilation, at other times too much.

The present invention is a garment system which provides a more economical, lighter weight, more compact, and comfortable solution to the requirements of such persons. The economy of the present system stems from its use of commonly available, inexpensive fabrics, and from a design which minimizes the length of exposed seams which require sealing. The weight and bulk reduction is achieved by constructing the two-part foundation garment, namely the shirt-jacket and pant, with certain permanently affixed, waterproof or water-resistant panels, which simultaneously serve to provide pockets, to protect against abrasion in critical areas, and to prevent ingress of moisture from wet ground vegetation or a wet seat, without significantly impairing the breathability of other parts of said foundation garments or causing the wearer to become excessively warm in hot weather. Said panels allow full protection against precipitation, wind etc. to be achieved with the detachable addition of shingling a removable yoke, a removable, optional hood, and removable chaps, which removable components are considerably less bulky and lighter than a separate, full rainsuit. The compact nature of said system is enhanced by the provision, in said foundation garment, of pockets capable of stowing said removable components. Finally, comfort is assured through the use of an appropriate fabric for all portions of said foundation garment in contact with the wearer's skin or undergarments, and by providing adjustable ventilation openings in said foundation garment and between said foundation garment and said removable components.

Hunters in particular may find the present garment system superior when constructed of fabrics printed with a camouflage pattern, since said yoke and hood can, if so constructed, be reversed to expose a blaze orange lining when required by law or when otherwise prudent. In addition, hunters require quiet non-rustling carry-along rainwear, precluding the use of lightweight waterproof fabric, for example coated nylon, and therefore placing a premium on compact design of any rainwear constructed of quieter but necessarily bulkier fabric.

SUMMARY OF THE INVENTION

The present invention is a garment system comprising a foundation garment suitable for fair weather wear, and four removable water-resistant components which are either stowed in pockets in said foundation garment, or worn in conjunction with said foundation garment to provide protection from precipitation and/or wind. Additional undergarments can be worn to provide insulation against cold if required.

The two-part foundation garment comprises a shirt-jacket and a pant. These foundation garments are designed of breathable, non-water-resistant fabric for fair weather wear but are constructed with waterproof or water resistant fabric panels on the chest, back, lower legs, and lower arms, and around the hips and upper thighs, of "Goretex" fabric, for example, to allow the wearer to walk, crawl, or sit on wet vegetation or a wet or abrasive surface without the ingress of moisture or damage to said foundation garment. A second objective of said water-resistant panels is to provide an outer wall for pockets on the chest, in the lower back and seat areas, for storage of said removable components and other items, including a cushion in the seat area. The chest and back panels are joined under the arms with an adjustable closure device, protected by a storm flap, to provide a variable degree of ventilation.

The removable water-resistant overlapping components comprise a hood, a yoke equipped with partial sleeves, and two upper thigh chaps, all constructed of a waterproof or water resistant fabric and provided with a means of detachable overlapping attachment to said foundation shirt-jacket or pant, such that, when attached, the wearer is protected from precipitation and wind. Said means of attachment prevents the ingress of water but allow the passage of air to an adjustable degree.

Finally, the present invention reduces the total length of seam exposed to the elements, thus reducing the cost of sealing said seams and/or improving the degree of protection afforded the wearer.

BRIEF DESCRIPTION OF THE DRAWING

Other objects and advantages of the invention will become more apparent from the specification taken in conjunction with the accompanying drawings, in which.

DETAILED DESCRIPTION OF THE INVENTION

Figure 1:
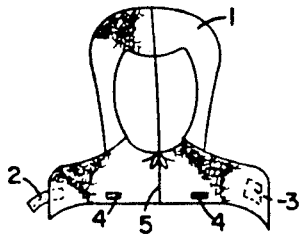
FIG. 1 is a front view of the removable hood.

The drawing shown in FIG. 1 depicts a hood constructed of two mirror image panels 1 of waterproof or water resistant outer fabric, lined with a soft fabric, said hood having an adjustable means of closure 2 and 3 around the neck, buttonholes 4 to allow the hood to be temporarily attached to a collar (not shown), and a draw string 5 passing between the outer fabric of the hood panels 1 and their lining so as to encircle the wearer's face.

Figure 2:
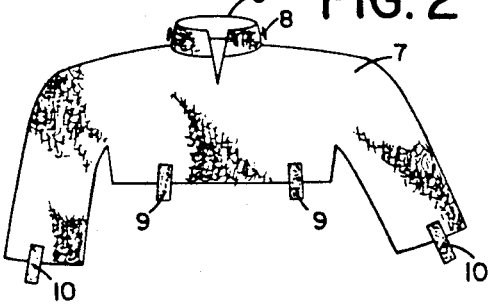
FIG. 2 is a front view of the removable, partially sleeved yoke.

FIG. 2 depicts the sleeved yoke 7, provided with a collar 6, to which said hood may be temporarily attached by means of buttons 8, in such a way that water running down off the hood will pass over the outside of said collar. The yoke 7 is further provided with adjustable tabs 9 on the chest and similarly on the back (not shown), and on the front of the partial sleeves 10, to enable said yoke to be temporarily attached to a shirt-jacket shown in FIGS. 4–6.

Figure 4:
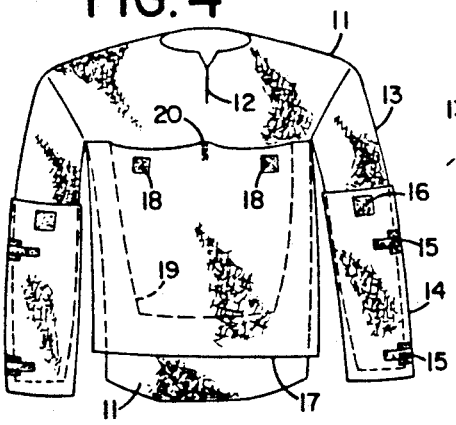
FIG. 4 is a front view of the shirt-jacket.

The length of the yoke sleeves and body are sufficient to overlap with corresponding water-resistant panels of the shirt-jacket depicted in FIG. 4.

Figure 3:
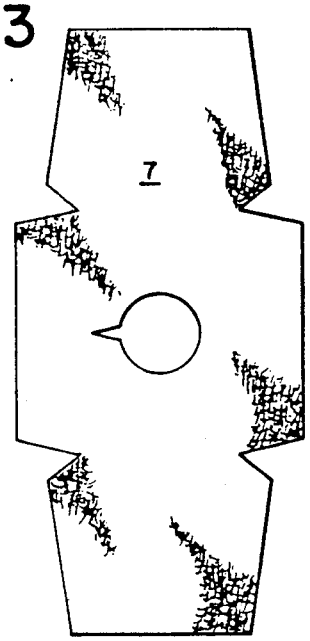
FIG. 3 is a plan view of the most advantageous pattern for the yoke.

FIG. 3 shows the preferred construction of the yoke 7, which method confines seams to the armpit and inner arm area and thus eliminates the direct incidence of normal rainfall on any upwardly exposed seam.

Figure 5:
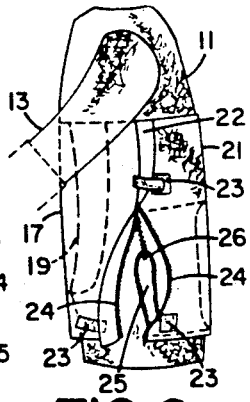
FIG. 5 is a partial side view of the shirt-jacket.

FIG. 4 depicts the shirt-jacket which is worn in fair weather, and to which said yoke (with or without said hood attached thereto) may be attached during rainy, windy or cold weather conditions. The shirt-jacket comprises an undershirt 11 with tails and an adjustable neck opening 12, long sleeves 13, all of soft, breathable non-water-resistant fabric, to be covered by the yoke 7 of FIG. 2 in wet weather; together with a chest panel 17, two forearm gaiters 14, and a back panel 21. FIG. 5, all of waterproof or water resistant fabric and permanently attached to said undershirt or sleeves. The purpose of said forearm gaiters is to allow the wearer to crawl on a wet or abrasive surface, or to draw back and release a bow without discomfort to the wearer or damage to said sleeves. Said forearm gaiters are equipped with adjustable gathering straps 15 to exclude drafts and prevent snagging of a bowstring when required, and with anchor points 16 for engaging adjustable tabs 10 of said partially sleeved yoke. Said chest panel 17 is equipped with anchor points 18 to allow the attachment of tabs 9 of said yoke, and in addition serves as the outer wall of a chest storage pocket 19, the opening of which is divided by a sewn attachment 20 to said undershirt, to prevent said pocket from sagging under load and also to allow the wearer to stow to the left or right a camera or binocular hanging from a strap around the wearer's neck, so that a bowstring can be freely drawn back against the chest. When attached to the chest and arms by means of said anchor points 18 and 16 respectively, said yoke 7 overlaps and channels water over the outside of said chest and back panels and said forearm gaiters, while allowing the passage of air between said yoke 7 and said shirt-jacket to a degree controlled by the adjustment of the tension with which said tabs are attached to said anchor points.

FIG. 5 depicts the back panel 21 referenced in the above discussion of FIG. 4, and the manner in which a storm flap of waterproof or water resistant fabric 22, equipped with tab and anchor closures 23, and a zipper 24, are employed on either side of said shirt-jacket to join said chest and back panels in such a way that the wearer can control the degree of ventilation. By opening said zipper, but keeping said tabs attached, for example, the wearer can achieve ventilation without the ingress of water. FIG. 5 also illustrates the construction of a lumbar pocket 25 formed by said back panel and a pocket liner, accessed on one side by opening said zipper, and provided with an inner zipper 26 to provide closure. Said lumbar pocket is intended for stowage of said hood, yoke, and chaps when not required.

Figure 6:
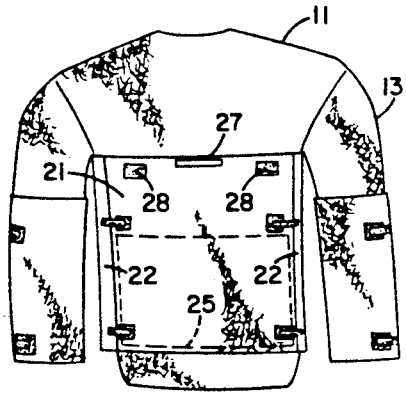
FIG. 6 is a back view of the shirt-jacket.

FIG. 6 provides a rear view of said back panel 21, depicting the positioning of an optional attachment point 27 for a hunting licence holder and of anchor points 28 for said tabs on said yoke.

Figure 7:
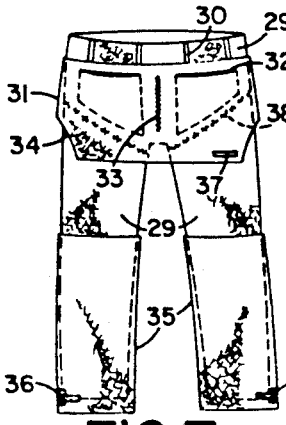
FIG. 7 is a front view of the pant.

FIG. 7 depicts a front view of the pant, which may be worn with said shirt-jacket in fair weather. The pant comprises an inner pant 29 of soft, breathable non-water-resistant fabric, with elasticized waist and ankle openings, and is equipped with belt loops 30, a skirt 31, and two leg gaiters 35, all of waterproof or water resistant fabric. Said skirt is equipped with two front pockets 32, and is designed with cutouts 34 on both sides to allow unrestricted motion and access to a zippered fly 33 in said inner pant, and with an additional optional reinforced low-socket opening 37 over the left or right thigh as appropriate to support the tip of a bow limb while the bow itself is held upright in the ready position. Said skirt is designed and positioned such that said chest and back panels extend overlapping over and below the top of said skirt when said pant is worn in conjunction with said shirt-jacket. The purpose of said leg gaiters is to allow the wearer to walk through or crawl on wet vegetation or abrasive surfaces without damage or discomfort, and adjustable ankle gathering closures 36 are provided to support this objective.

Figure 8:
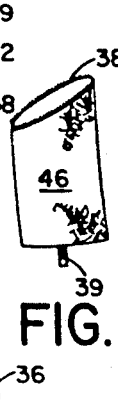
FIG. 8 is a front view of one of the chaps.
Figure 10:
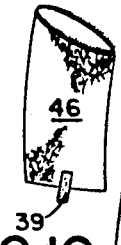
FIG. 10 is a back view of one of the chaps.

FIG. 8 provides a front view of a removable thigh chap 46, showing the split zipper 38 and tab 39 provided for attachment to said inner pant under said skirt and to an anchor point behind the knee of said pant respectively, covering the wearer's thigh and if desired his upper calf as well, overlapping such that water running down said skirt will be deflected over the outer surface of said chap and thence over the outer surface of said leg gaiter. With said chaps in place, ventilation is maintained around the pelvic area, above the knee, and, if desired, at the ankle. FIG. 10 provides a rear view of said removable thigh chap 46, better showing the placement of said tab 39, and showing the anchor points 43 for attachment of said chaps by means of said tabs.

Figure 9:
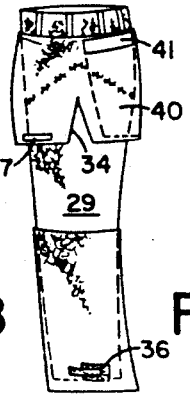
FIG. 9 is a side view of the pant.
Figure 11:
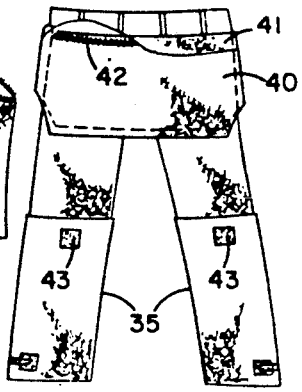
FIG. 11 is a back view of the pant.

FIG. 9 shows the placement of a rear pocket 40 in said skirt, and the storm flap 41 provided to protect the opening of said pocket, which is provided with a zipper 42 as shown in FIG. 11. The rear pocket is designed to accommodate an insulating cushion (not shown), to allow the wearer to sit on a cold and/or wet seat for extended periods of time without discomfort, but can be used for stowage of said chaps or other items at the discretion of the wearer.

It is thus seen from the preceeding description that the various items of clothing function together as a garment system which affords the wearer comfort and protection in changing weather conditions, providing shingled protection from precipitation and wind without unduly burdening the wearer with additional items of clothing or causing discomfort in fair weather or when physical exertion is called for. The use of a subset of the items of clothing which constitute the system, for example the shirt-jacket and yoke alone by a fisherman wearing waders in place of the pant, is also possible and provides similar advantages; furthermore, the disclosure of the invention described represents an embodiment particularly suited for persons engaged in bowhunting, with the added provision that all fabrics are quiet, non-rustling and printed with a camouflage pattern; however, variations thereof, for example the use of a fully sleeved yoke or full leg chaps, obviating the need for leg and arm gaiters, the modification of the yoke to allow it to be reversed to display a different pattern or color, for example blaze orange, are possible, and these variations are included in the spirit and scope of the appended claims.

I claim:

1. An all-weather garment assembly comprising a plurality of detachable components, including:

A. a two-part foundation garment of non-water-resistant fabric, including 1) a shirt-jacket forming an upper-body foundation garment portion, and 2) a pant forming a lower-body foundation garment portion, having a water-resistant hip-covering skirt, B. a removable sleeved yoke constructed of water-resistant rainproof fabric to encase the arms, shoulders, upper chest and back, overlapping and detachably attached to said shirt-jacket, C. a pair of leg chaps of water-resistant rainproof fabric detachably attached to said pant, D. both portions of said two-part foundation garment incorporating water-resistant rainproof panels exposed wherever said yoke or leg chaps when worn do not afford the wearer protection from precipitation, and E. means for removable attachment of said yoke and said leg chaps to a respective portion of said two-part foundation garment in top-to-bottom shingled overlapping water-shedding relation, whereby when worn together, said yoke, said leg chaps and said two-part foundation garment form a rainproof assembly.

2. An all-weather jacket assembly comprising a plurality of detachable components, including:

A. a shirt-jacket forming an upper-body foundation garment portion of non-water-resistant fabric, and B. a removable sleeved yoke constructed of water-resistant rainproof fabric to encase the arms, shoulders, upper chest and back, overlapping and detachably attached to said shirt-jacket, C. said shirt jacket garment incorporating water-resistant rainproof panels exposed wherever said yoke when worn does not afford the wearer protection from precipitation, and D. means for removable attachment of said yoke to said upper-body foundation garment in top-to-bottom shingled overlapping water-shedding relation, whereby when worn together, said yoke and said upper body foundation garment form a rainproof assembly.

3. An all-weather pant assembly comprising a plurality of detachable components, including:

A. a pant forming a lower-body foundation garment portion of non-water resistant fabric, having a water-resistant hip-covering skirt, B. a pair of leg chaps of water-resistant rainproof fabric detachably attached to said pant, C. said lower-body foundation garment incorporating water-resistant rainproof panels exposed wherever said leg chaps when worn do not afford the wearer protection from precipitation, and D. means for removable attachment of each of said leg chaps to a respective portion of said lower-body foundation garment in top-to-bottom shingled overlapping water-shedding relation, whereby when worn together, said leg chaps and said foundation garment form a rainproof assembly extending from the wearer's waist downward.

4. An all weather jacket assembly as claimed in claim 2 wherein said sleeved yoke is constructed with seams restricted to the inner arms and the armpit area.

5. A skirt as defined in claim 3, wherein said shirt is provided with a pocket in the seat area for the conveyance of a seat cushion or other items.

6. A skirt as defined in claim 3, wherein said skirt is constructed with a means for supporting the tip of a bow limb when said tip is placed on the thigh and held upright in ready position.

7. The garment assembly defined in claim 1 or claim 2 wherein said yoke has an outer surface and an inner surface constructed of fabrics contrastingly different in appearance, and wherein said attachment means are positioned to cooperate alternatively with the outer surface and with the inner surface of said yoke, whereby said yoke may be reversed at will and worn with its outer surface or its inner surface upwardly exposed.

8. The all-weather assembly defined in claims 1 or 2 wherein said shirt jacket includes water-resistant panels forming forearm gaiters extending from the wrist to the elbow area, and wherein said water-resistant yoke is equipped with partial sleeves extending overlappingly below the upper elbow edge of said forearm gaiters.

9. The all-weather assembly defined in claims 1 or 3 wherein said water-resistant hip-covering skirt extends a short distance below the crotch, and wherein said leg chap attachment means are positioned to secure said chaps outside the wearer's upper thigh under said overlapping skirt.

10. The all-weather assembly defined in claim 1 or claim 2, further including a water-resistant fabric hood overlapping and removably attached to a collar portion of said yoke, providing a rainproof covering for the wearer's head.

11. The assembly defined in claim 10, wherein said hood is a reversible hood having an outer surface and an inner surface constructed of fabrics contrastingly different in appearance, and is provided with attachment means positioned to cooperate with said yoke when worn with either its outer surface or its inner surface upwardly exposed.

* * * * *

UNITED STATES PATENT AND TRADEMARK OFFICE

CERTIFICATE OF CORRECTION

PATENT NO. :5,088,116
DATED :Feb. 18, 1992
INVENTOR(S) :Russell P. Gould

It is certified that error appears in the above-identified patent and that said Letters Patent is hereby corrected as shown below:

Col 4, line 19 "low-socket" should be --bow-socket--

Col 6, line 17 "shirt" should be --skirt--

Signed and Sealed this

Twentieth Day of July, 1993

*Attest:*

Michael K. Kirk

MICHAEL K. KIRK

*Attesting Officer*

*Acting Commissioner of Patents and Trademarks*